US006051183A

United States Patent [19]

Morando

[11] Patent Number: 6,051,183

[45] **Date of Patent: *Apr. 18, 2000**

[54] JET COLUMN AND JET COLUMN REACTOR DROSS REMOVING DROSS DILUTING PUMPS

[75] Inventor: Jorge A. Morando, Cadiz, Ky.

[73] Assignee: Alphatech, Inc., Cadiz, Ky.

[ * ] Notice: This patent is subject to a terminal disclaimer.

[21] Appl. No.: 09/178,603

[22] Filed: Oct. 26, 1998

Related U.S. Application Data

[63] Continuation-in-part of application No. 08/876,636, Jun. 16, 1997, abandoned, and a continuation-in-part of application No. 08/876,668, Jun. 16, 1997, abandoned, and a continuation-in-part of application No. 08/876,669, Jun. 16, 1997, abandoned, which is a continuation-in-part of application No. 08/489,322, Jun. 12, 1995, Pat. No. 5,683,650.

[51] Int. Cl.[7] ..... C21B 3/04

[52] U.S. Cl. ..... 266/227; 266/239

[58] Field of Search ..... 266/44, 112, 133, 266/227, 239, 280; 118/422

[56] References Cited

U.S. PATENT DOCUMENTS 5,683,650 11/1997 Morando ..... 266/44

OTHER PUBLICATIONS

National and Karbate Brochure, Carbon and Graphite products, National Carbon Co. Inc., Jan. 1948.

*Primary Examiner*—Scott Kastler
*Attorney, Agent, or Firm*—Charles W. Chandler

[57] ABSTRACT

A gas jet-operated pump for removing dross from the surface of a bath of molten metal. The pump can be employed for delivering molten metal to the dross for diluting it or for removing it from a selected area.

24 Claims, 8 Drawing Sheets

JET COLUMN AND JET COLUMN REACTOR DROSS REMOVING DROSS DILUTING PUMPS

CROSS REFERENCE TO RELATED APPLICATIONS

This application is a continuation-in-part of Ser. Nos. 07/876,636; now abandoned 08/876,668; now abandoned and 08/876,669, now abandoned all filed Jun. 16, 1997, which in turn are continuation-in-part applications of Ser. No. 08/489,322, filed Jun. 12, 1995 for "Bubble Apparatus for Removing and Diluting Dross in a Steel Treating Bath", and since issued as U.S. Pat. No. 5,683,650, Nov. 4, 1997.

BACKGROUND OF THE INVENTION

This invention pertains to jet-operated pumps for removing or diluting dross from the surface of a bath of molten metal, and more particularly a pump in which a gas is introduced into the pump conduit removing or diluting the dross, in the same direction (a "jet") as that of the moving metal/dross.

This invention further pertains to a pump in which the gas is introduced into the pump conduit in the form of a gas jet through a convergent/divergent nozzle. This invention also pertains to a composite material jet-operated pump for removing or diluting dross from the surface of a bath of molten metal. Steel utilized in the automotive, construction and appliance industries and the like is formed in very thin strips (0.015 to 0.060 inches thick), which are then passed through a molten bath of either aluminum (aluminizing), zinc (galvanizing) or aluminum/zinc (galvalume). The strip width usually ranges from 30 to 70 inches. To avoid the formation of oxides on the strip'surface that are detrimental to the coating quality, the strip is delivered to the molten bath from a nitrogen/hydrogen filled furnace through a tubular housing (snout), also filled with the same gas.

Because of the extremely large dimensions of the equipment, and in spite of efforts to prevent air leaks into the furnace, small air leaks occur, generating ferrous oxides ($Fe_2O_3$, FeO, etc.).

When the steel strip enters the bath, a chemical process occurs in which the aluminum or zinc in the bath reacts with the iron oxides to form dross, aluminum oxides ($Al_2O_3$) and/or zinc oxides (ZnO). The released free iron settles to the bottom of the molten metal pot. Because of their slightly lower density in the molten metal, alumina ($Al_2O_3$) and zinc oxide (ZnO), remain in suspension or float to the surface. This dross accumulates in the area enclosed by the snout. Since the dross is generally a very hard ceramic and usually contains large particulates that adhere to the steel strip being processed, a defective coating, having a poor appearance and high rejection rates may result.

In U.S. Pat. No. 5,683,650, a bubble-operated pump is disclosed in which an inert gas is introduced into a conduit having its inlet end disposed beneath the surface of a bath of molten metal. The conduit is generally U-shaped with a pair of upright legs. One leg has an inlet opening in the dross layer. The other leg has an outlet opening disposed outside of the snout housing which contains the dross. In a dross-diluting version, the positioning of the inlet and outlet is reversed. A gas is introduced in the outlet leg in a direction at right angles to the motion of the dross/metal. Upon being introduced into the conduit, the gas creates spaced apart bubbles which induce the flow of metal/dross toward the outlet opening. This pump is a reliable and inexpensive mechanism having no moving parts for removing dross from the surface of a molten metal bath enclosed in a delivery snout.

Moreover, the pump comprises a one-piece tubular conduit having an inlet side for receiving molten metal and an outlet side for discharging the metal. A source of an inert gas such as nitrogen (or argon) is connected in the outlet side of the conduit to produce the stream of rising bubbles. As the nitrogen bubbles upwards toward the surface, it creates a suction effect in the inlet side of the conduit generating a flow of metal in the same direction. However, in certain instances, the gas creates a fluidic blockage, retarding the flow.

SUMMARY OF THE INVENTION

The broad purpose of the present invention is to provide an improved dross removing or diluting pump by providing a U-shaped conduit having its inlet and outlet openings disposed in the bath of metal. The gas is introduced into the conduit adjacent a lower portion in a direction that coincides with the path of motion of the molten metal/dross as it moves towards the outlet opening. The momentum of the gas assists in the molten metal flow. The direction at which the gas is introduced obviates any tendency of the gas to block the metal flow. Throughout this specification, the "flow" is interchangeably referred to as dross and molten metal as the material being pumped is generally some combination of the two.

Another purpose of the present invention is to provide an improved dross removing or diluting pump in which the body of the pump is made of different materials. The gas inlet conduit is formed of a graphite tube with a ceramic sleeve to protect the tube above the metal line from air burning while the remaining components are constructed of ceramic, graphite, or special alloys depending upon the metal into which the pump is intended to be submerged.

Another purpose of the present invention is to provide a further improved dross removing or diluting pump. Particularly, a gas jet is introduced into the U-shaped conduit and into a converging/diverging nozzle in the same direction as the dross and/or molten metal is moving.

Still further objects and advantages of the invention will become apparent to those skilled in the art to which the invention pertains upon reference to the following detailed description.

DESCRIPTION OF THE DRAWINGS

The description refer to the accompanying drawings in which like reference characters refer to like parts throughout the several views and in which.

DESCRIPTION OF THE PREFERRED EMBODIMENTS

Figure 1:
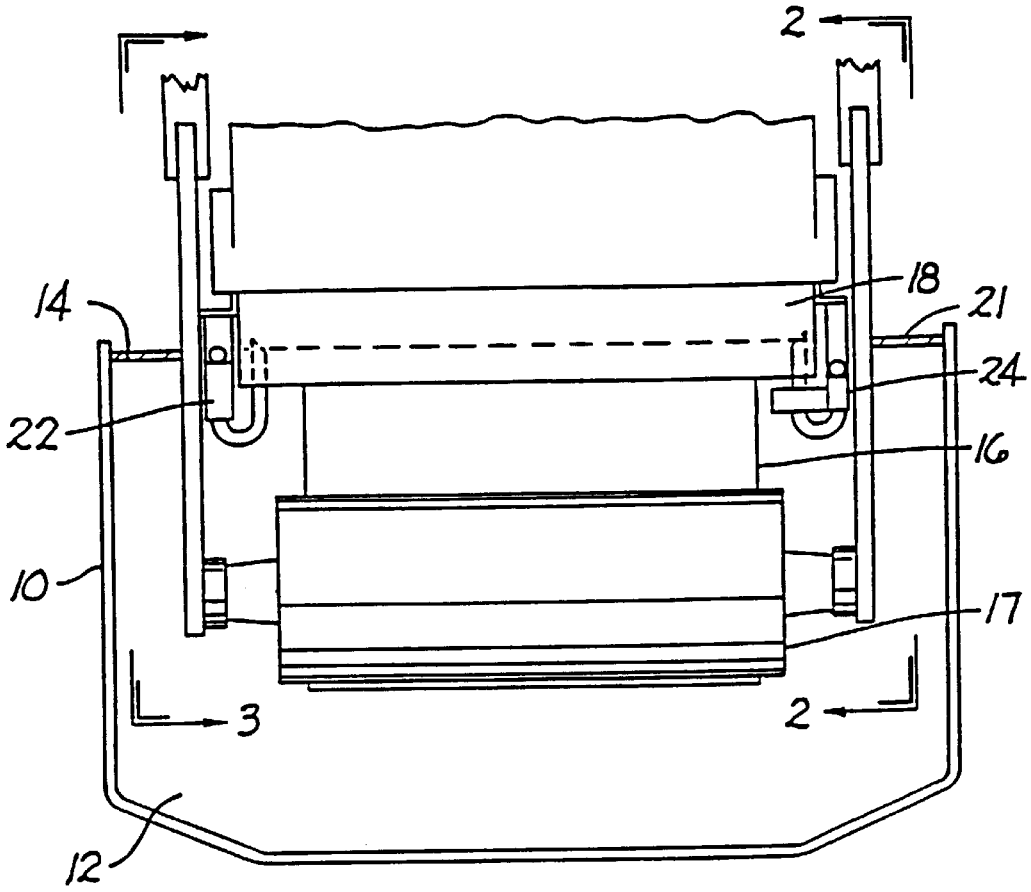
FIG. 1 is a schematic sectional view of a molten metal bath showing the location of a preferred dross removal pump.
Figure 3:
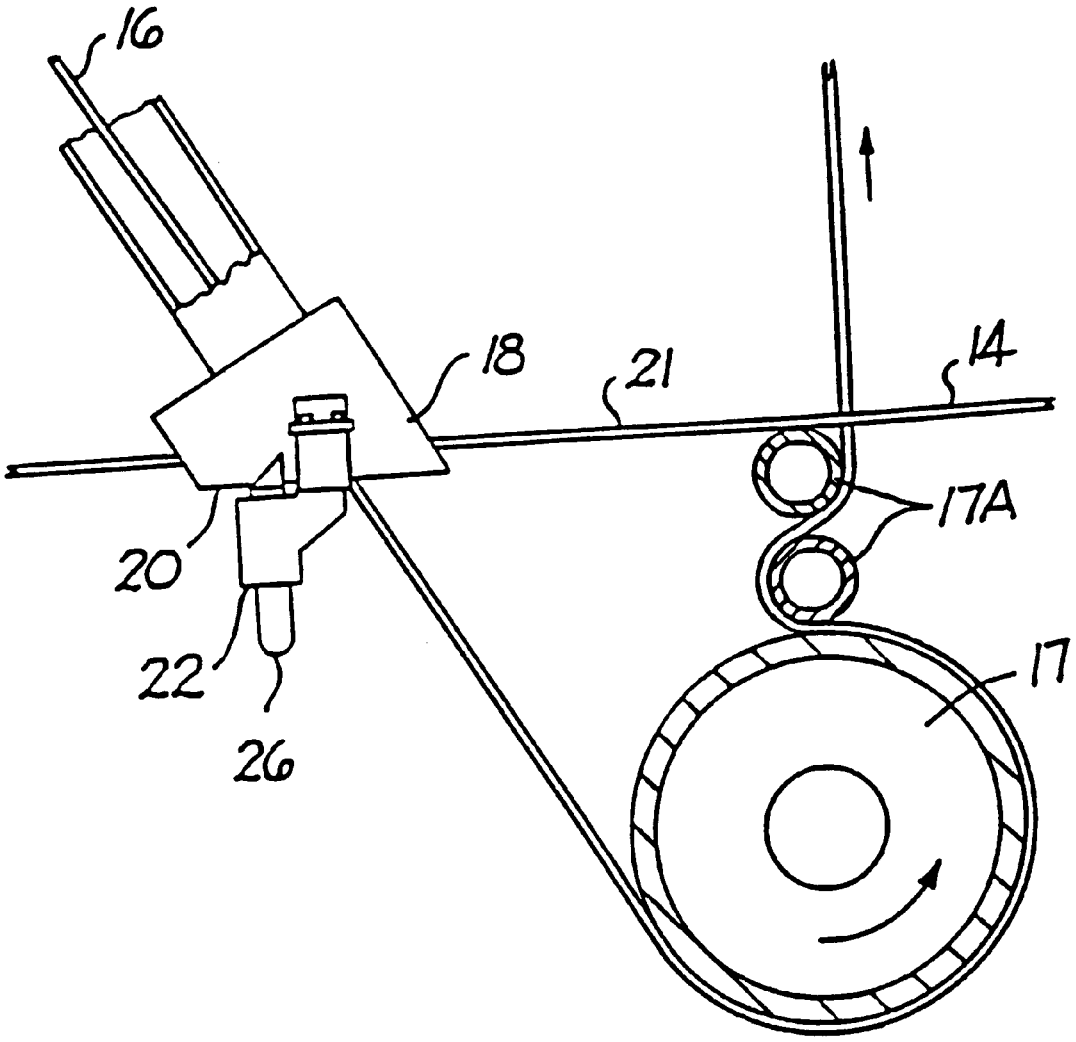
FIG. 3 is an enlarged sectional view as seen along lines 3—3 of FIG. 1 illustrating the dross removal location.

Referring to the drawings, FIG. 1 illustrates a conventional heated metal pot 10, which for illustrative purposes contains a bath of molten aluminum 12. The bath has a top surface 14, usually referred as to the molten metal line. A continuous moving strip of low carbon steel 16 is introduced into the bath from a furnace (not shown) in the conventional manner as illustrated in FIG. 3. The strip passes around a sink roll 17, and tensor roll 17A while submerged in the bath, so that the surface of the strip picks up an aluminum coating.

Strip 16 is delivered to the bath through a conventional tubular snout housing 18. The interior of the housing contains an inert gas, such as nitrogen, or a mix of nitrogen and hydrogen which, as is well known to those skilled in the art, is useful in preventing the steel strip from oxidizing. Oxidation damages the coating being applied to the strip.

Figure 2:
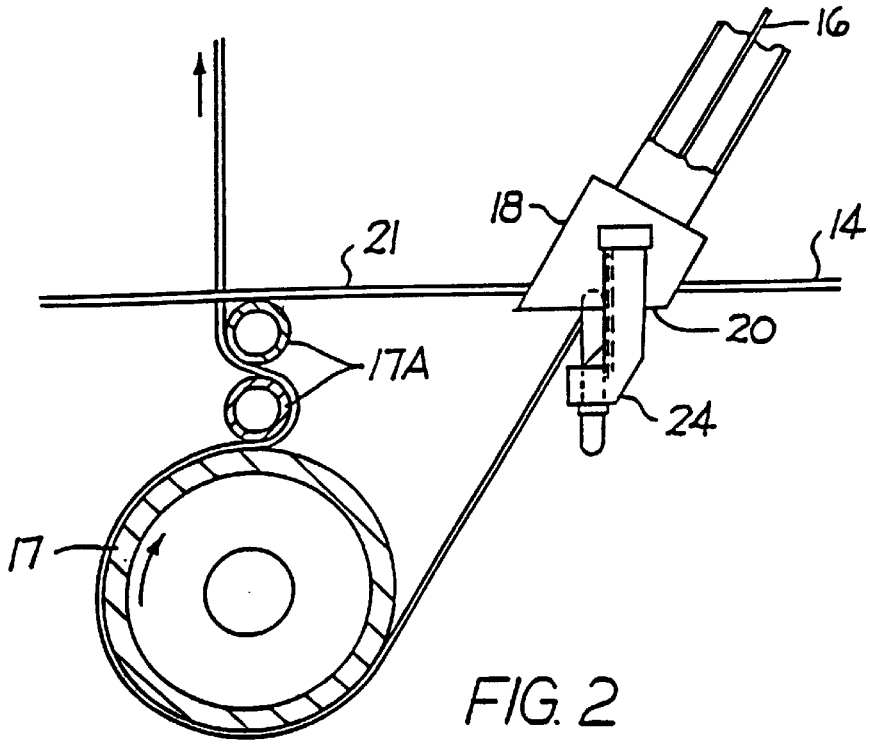
FIG. 2 is an enlarged sectional view as seen along lines 2—2 of FIG. 1.

The lower exit opening 20 of the snout housing is disposed 6" to 12" below top surface 14 of the bath in order to assure a sealed area for the inert gas filling the furnace and the snout. The steel strip enters the bath through lower opening 20 of the snout housing, submerged into the metal by the rotating rolls as shown in FIGS. 2 and 3. The strip emerges from the bath and passes toward its destination.

The chemical reaction occurring between the steel strip, the steel strip oxides and the aluminum or zinc bath creates a dross layer 21 that accumulates at surface 14 and is particularly heavy inside the snout housing. An inert gas jet-operated dross removal pump means 22 removes dross from layer 21. A second inert gas jet-operated dross diluting pump means 24 delivers metal into the dross layer inside the snout housing to dilute the dross.

Figure 4:
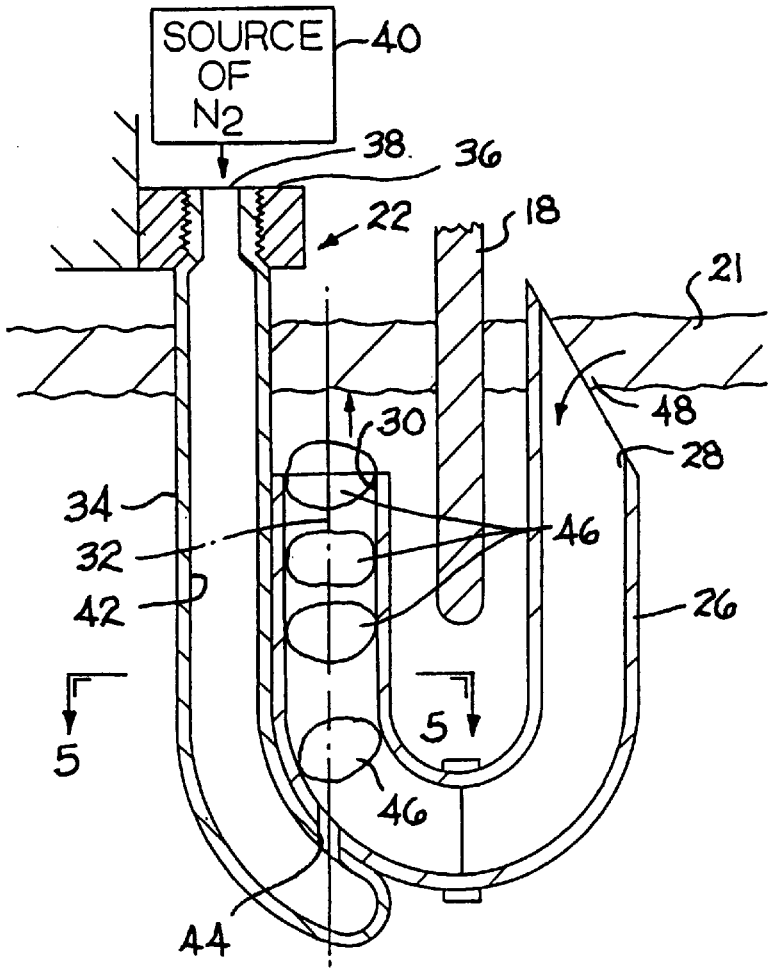
FIG. 4 is a longitudinal sectional view of a preferred dross removal pump.
Figure 5:
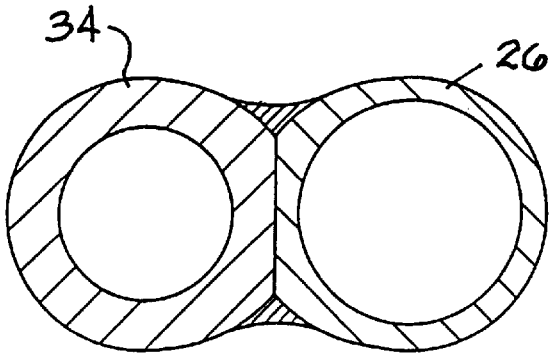
FIG. 5 is an enlarged sectional view as seen along lines 5—5 of FIG. 4.

Referring to FIGS. 4 and 5, the dross removal pump (a jet column reactor) has a generally U-shaped tubular conduit 26. The tubular conduit can be manufactured from different materials depending upon the particular molten metal in the bath. In a zinc galvanizing bath, conduit 26 can be manufactured from a stainless steel material or other super alloy materials available from Alphatech Inc., of Cadiz, Kentucky specially formulated for resistance to zinc at temperatures up to 1400□ F. In galvalume (aluminum and zinc) or aluminum, conduit 26 can be manufactured from any ceramic material resistant to these molten metals, examples of which are also available from Alphatech, Inc.

The diameter of conduit 26 depends upon the amount of dross flow expected to be removed by the pump. For most existing galvanizing and aluminizing lines, a tube diameter of 2.5" to 3" should be sufficient.

The conduit has an upper inlet opening 28 formed at an angle of 45□ to 60□ with respect to the vertical leg of the conduit and is supported in dross layer 21 of the bath. Conduit 26 has an outlet opening 30 formed at right angles with respect to the outlet leg of the conduit, as shown in FIG. 4. Opening 30 is disposed 2" to 6" below dross layer 21. Both inlet opening 28 and outlet opening 30 face upwardly. The outlet leg of the pump is supported in a vertical position so that the dross enters through the inlet opening, passes vertically downwardly and then rises vertically along an axis of motion 32.

Pump body 34, in this particular application for molten aluminum, is manufactured from a ceramic material with an upper portion connected to an upper support 36. The pump body 34 essentially comprises a second conduit having an upper inlet opening 38 for receiving an inert gas from a source 40. The pump body has an internal passage 42 which passes from inlet opening 38 down toward a position beneath and aligned with axis 32. A gas opening 44 fluidly connects passage 42 to the interior of the leg, terminating with outlet opening 30. Opening 44 is directly aligned with the path of motion of the dross—as defined by the axis of motion 32—as it rises in the outlet leg of the conduit. The gas opening is illustrated as a single opening, however, it can comprise a series of gas injecting nozzles, each having a diameter of 0.020" to 0.500" to form a gas jet into the conduit. The gas jet coalesces and forms bubbles that rise in the same direction as the motion of the dross. If high pressure gas is used, the gas momentum will add to the dross velocity and improve the efficiency of the pump. The pump apparatus involves no moving parts exposed to the molten metal.

Figure 6:
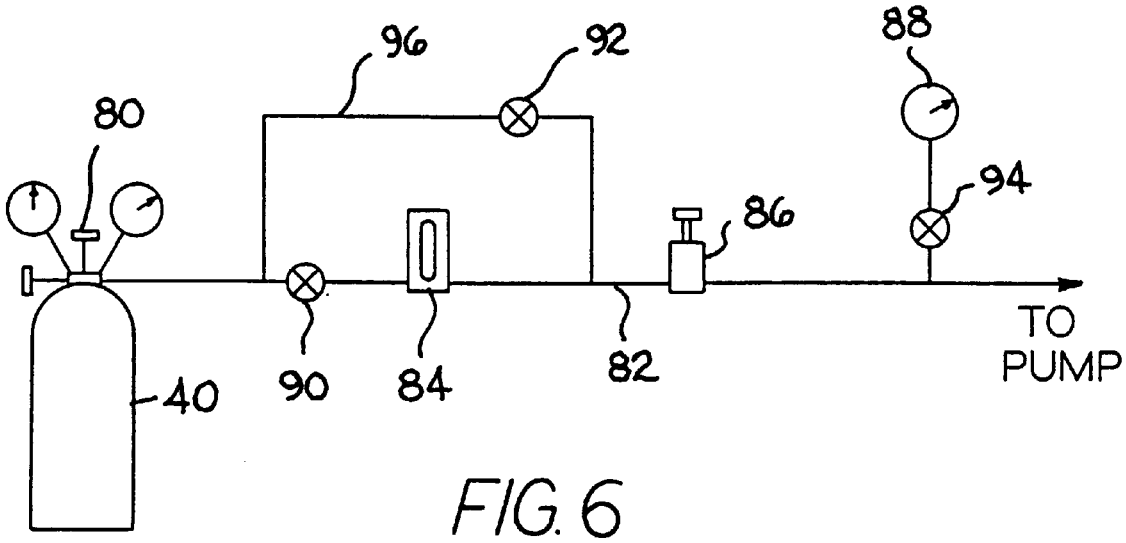
FIG. 6 illustrates an inert gas delivery system schematic for a continuous gas flow arrangement.
Figure 7:
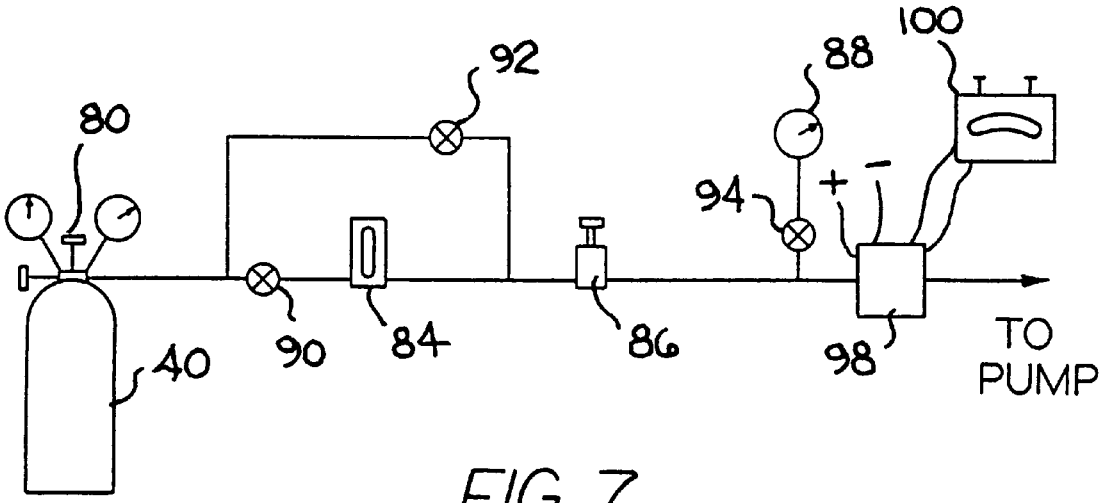
FIG. 7 illustrates an inert gas delivery system schematic for a pulsating gas flow arrangement.

FIGS. 6 and 7 show the means for modulating the pressure of the inert gas being received from a compressed gas tank 40. The gas may be either gaseous or liquid nitrogen, argon or helium. A coarse pressure regulator 80 is mounted on the tank for regulating the pressure down from a range of 3000/2000 p.s.i. to 200 plus or minus 100 p.s.i.

A conduit 82 delivers the gas from source 46 to the pump. Gas flow meter 84 is connected in the conduit for measuring the gas flow from 0 to 100 cfh. Higher gas flows may be required for a larger conduit pump body.

A regulator 86 is connected in conduit 82, downstream of the gas flow meter. Regulator 86 is a fine adjusting pressure regulator for regulating pressure down from 200 plus or minus 100 p.s.i. to 100 p.s.i. plus or minus 30 p.s.i. Lower or higher pressures may be required for different applications.

A pressure gage 88 is connected in the conduit for measuring the pressure and range from 0 to 100 p.s.i. A shut-off valve 90 is connected between compressed gas tank 40 and the gas flow meter. A bypass conduit 96 is connected around the gas flow meter and has a shut-off valve 92. A shut-off valve 94 is mounted between pressure gage 88 and conduit 82.

When the jet column reactor is being started up, valves 90 and 94 are opened to pass gas from the compressed gas tank to the pump. The gas is gradually increased by observing gas flow meter 84 and pressure gage 88. When the gas pressure and flow rate have reached acceptable levels, valve 90 is closed and valve 92 is opened so that the gas passes around the gas flow meter. In addition, valve 94 is closed to isolate the pressure gage. Both the flow meter and the pressure gage are isolated in order to protect them from the pulsations that occur in the system. The system provides a continuous flow of gas to the pump.

FIG. 7 illustrates a control system similar to FIG. 6, but in which a solenoid valve 98 is connected in the conduit with an on/off timing device 100 providing an intermittent charge of gas and which can be regulated between 0 to 2 seconds between charges. For illustrative purposes, almost 20,000 pounds per hour of dross may be removed from the pot using 40 standard cubic feet per hour of nitrogen at 15 to 25 p.s.i.

The jet column reactor is illustrated for removing dross from molten aluminum, however, it can also be used with slight modifications for Zn, Mg, ZnAl alloys and/or recirculating the aluminum in a bath.

Figure 8:
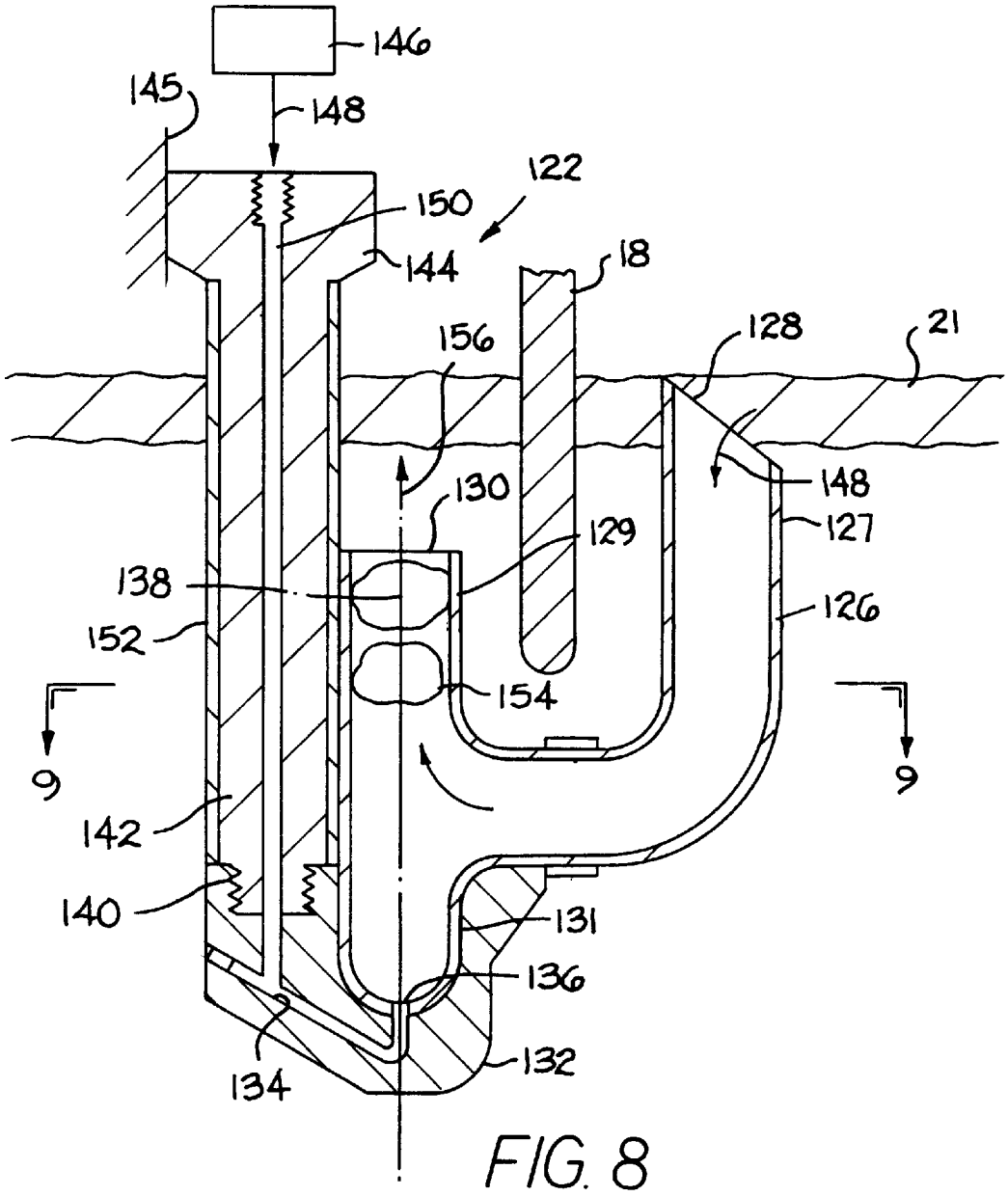
FIG. 8 is a longitudinal sectional view of another embodiment of the dross removal pump.
Figure 9:
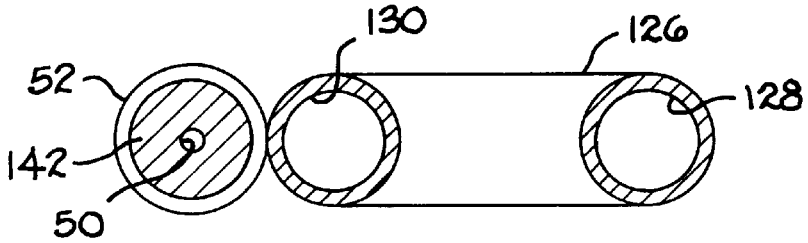
FIG. 9 is a view as seen along lines 9—9 of FIG. 8.

Referring to FIGS. 8 and 9, dross removal pump 122 includes a generally U-shaped tubular conduit 126. The tubular conduit can be manufactured from different materials, depending on the particular molten metal bath. In a zinc galvanizing bath, conduit 126 can be manufactured from a stainless steel material. In galvalume (aluminum and zinc) or aluminum, conduit 126 can be manufactured from any ceramic material resistant to molten metals.

The diameter of conduit 126 depends upon the amount of dross flow expected to be removed by the pump. For most existing galvanizing and aluminizing lines, a tube diameter of 2.5 to 3 inches should be sufficient.

Conduit 126 has a vertical inlet conduit leg 127 with an upper inlet opening 128 formed at an angle of 45□ to 60□ with respect to the vertical inlet leg of the conduit, and supported in dross layer 21. Conduit 126 has a vertical outlet leg 129 with an upper outlet opening 130 as shown in FIG. 8. Opening 130 is disposed 2 to 6 inches below dross layer 21. Inlet opening 128 and outlet opening 130 face upwardly. Leg 129 has a hollow lower extension 131.

A pump body 132 is attached to conduit 126. Body 132, in this particular application for molten aluminum, is manufactured from a graphite material. Body 132 has an inclined internal gas passage 134 with a lower vertical outlet connected to an opening 136 in the lower extension of conduit 126. Opening 136 is aligned with the path of motion of the dross as it rises through outlet leg 129 along vertical axis 138.

Body 132 has an internally threaded end 140. An elongated vertical graphite tube 142 has a lower end threadably connected to threaded end 140, below the metal line, and an upper enlarged end 144 supported by any suitable means 145 above the metal line. A source 146 of an inert gas, such as nitrogen, is connected by conduit means 148 to a gas passage 150 in tube 142. Passage 150 is connected to passage 134 for delivering gas under pressure in the form of a jet to opening 136. Tube 142 is encased in a ceramic sleeve 152 to prevent air burning of the graphite tube above the metal line.

The gas can be delivered either in a continuous or an intermittent form. In either case the gas emerges through opening 136 and forms a series of spaced bubbles 154 because of surface tension. The bubbles rise in the molten aluminum and dross. The rising bubbles entrap sections of molten aluminum and dross between them and carry them upwardly in the direction of arrow 156.

By applying an intermittent flow of gas as shown in FIG. 7, the utilization of the gas can be optimized by adjusting the frequency of the jet and bubble formation and the expansion rate to match a particular application. The rising bubbles induce a flow of molten metal towards outlet opening 130, generating a suction at inlet opening 128 which causes the dross located on the surface of the bath to move in the direction of arrow 148 into the inlet opening. A flow is created in conduit 126, thereby scavenging the dross from inside snout housing 18 to a location outside the housing where it can be skimmed off or removed by conventional means.

Figure 10:
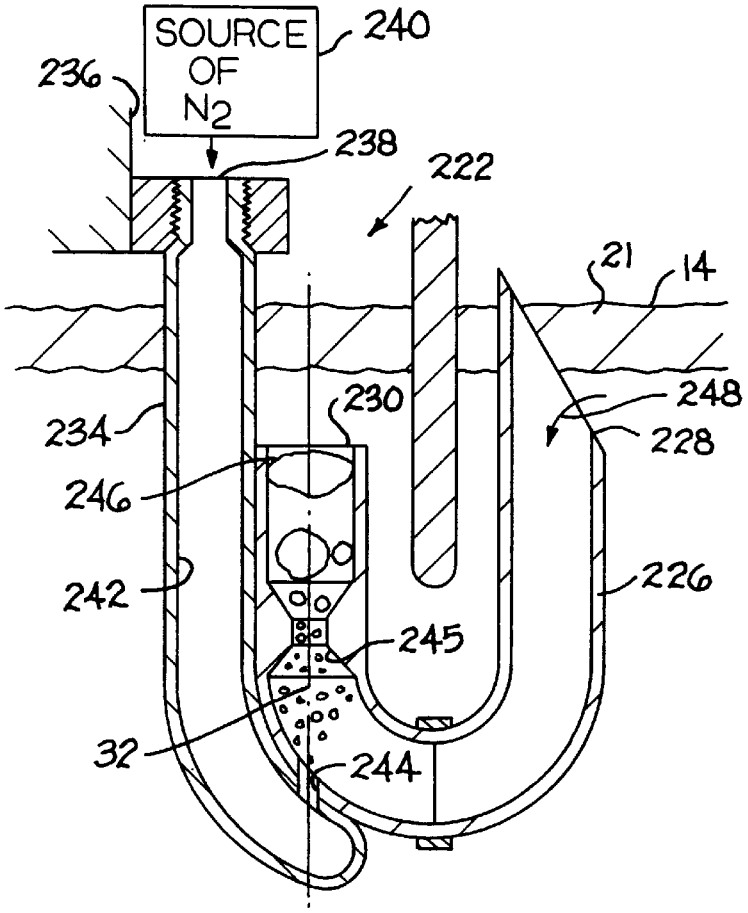
FIG. 10 is a longitudinal sectional view of still another preferred dross removal pump.
Figure 11:
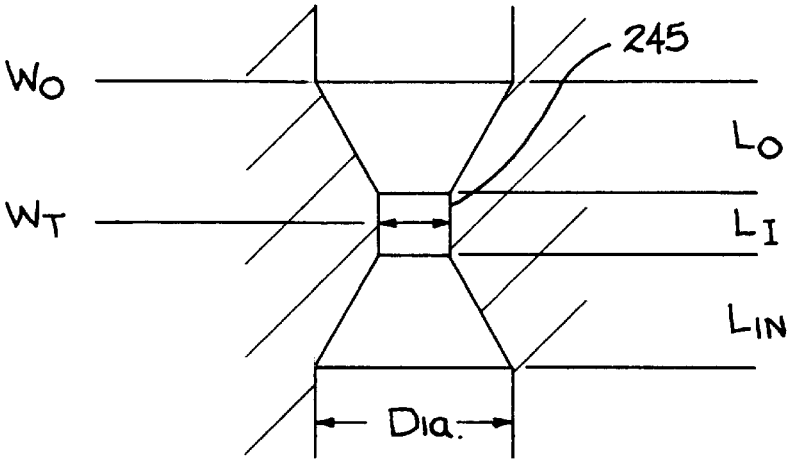
FIG. 11 is an enlarged sectional view of the converging/diverging nozzle of the pump of FIG. 10.

Referring to FIGS. 10 and 11, a jet column dross removal pump 222 having a generally U-shaped tubular conduit 226 is depicted. The tubular conduit can be manufactured from different materials depending upon the particular molten metal in the bath. In a zinc galvanizing bath, conduit 226 can be manufactured from a stainless steel material or another alloy specially formulated for resistance to zinc at temperatures up to 1400□ F. In galvalume (aluminum and zinc) or aluminum, conduit 226 can be manufactured from any ceramic material resistant to these molten metals.

The diameter of inlet opening 228 of conduit 226 depends upon the amount of dross flow expected to be removed by the pump. For most existing galvanizing and aluminizing lines, a tube diameter of 2.5" to 3" should be sufficient. The conduit has an upper inlet opening 228 formed at an angle of 45□ to 60□ with respect to the vertical inlet leg of the conduit and supported in dross layer 21 of the bath. Conduit 226 has an outlet opening 230 formed at right angles with respect to the outlet leg of the conduit, as shown in FIG. 10. Opening 230 is disposed 2" to 6" below dross layer 21. Both inlet opening 228 and outlet opening 230 face upwardly. The outlet end of the pump is supported in a vertical position so that the dross enters through the inlet opening, passes vertically downwardly and then rises vertically along an axis of motion 232.

Pump body 234, in this particular application for molten aluminum is made from a ceramic material with an upper portion connected to an upper support 236. The pump body comprises a second conduit having an upper inlet opening 238 for receiving an inert gas from a source 240. The pump body has an internal passage 242 which passes from inlet opening 238 down toward a position beneath and aligned with axis 232. A gas opening 244 fluidly connects passage 242 to the interior of the leg terminating with outlet opening 230. Opening 244 is directly aligned with the path of motion of the dross as it rises in the outlet leg of the conduit. The gas opening is illustrated as a single opening however it can comprise a series of gas injecting nozzles, each having a diameter of 0.020" to 0.500" to form a gas jet into the conduit. High pressure gas is used so the gas momentum adds to the dross velocity and improves the suction efficiency of the pump.

The outlet leg of the conduit has a converging/diverging nozzle 245 aligned with gas nozzle 244. The configuration of the nozzle shape has the following approximate ratios:

$$W_T = .90W_{in} \text{ to } .60W_{in}$$

$$W = \text{Width}$$

$$W_{in} = \frac{3.50 \text{ in}}{4.50 \text{ in}};\ L_{in} = \frac{.60\,W_{in}}{.80\,W_{in}};\ L_1 = \frac{.30\,W_{in}}{.50\,W_{in}};\ \text{and}$$

$$L_o = \frac{16.0_{\text{in}}}{20.0_{\text{in}}} \cdot W_0 = W_{in}$$

$$L = \text{Length}$$

The gas can be delivered either in a continuous or an intermittent form. In either case the gas emerges through opening 244 and forms a series of spaced bubbles 246 because of the surface tension. The bubbles rise in the molten aluminum and dross. The rising bubbles entrap sections of molten aluminum and dross between them and carry them upwardly in the direction of axis 232.

By applying an intermittent flow of gas as shown in FIG. 7, the utilization of the gas can be optimized by adjusting the frequency of the jet and bubble formation and the expansion rate to match a particular application. The rising bubbles induce a flow of molten metal towards outlet opening 230, generating a suction at inlet opening 228 which causes the dross located on the surface of the bath to move in the direction of arrow 248 into the inlet opening. A flow is created in conduit 226, thereby scavenging the dross from inside snout housing 18 to a location outside the housing where it can be skimmed off or removed by conventional means.

Figure 12:
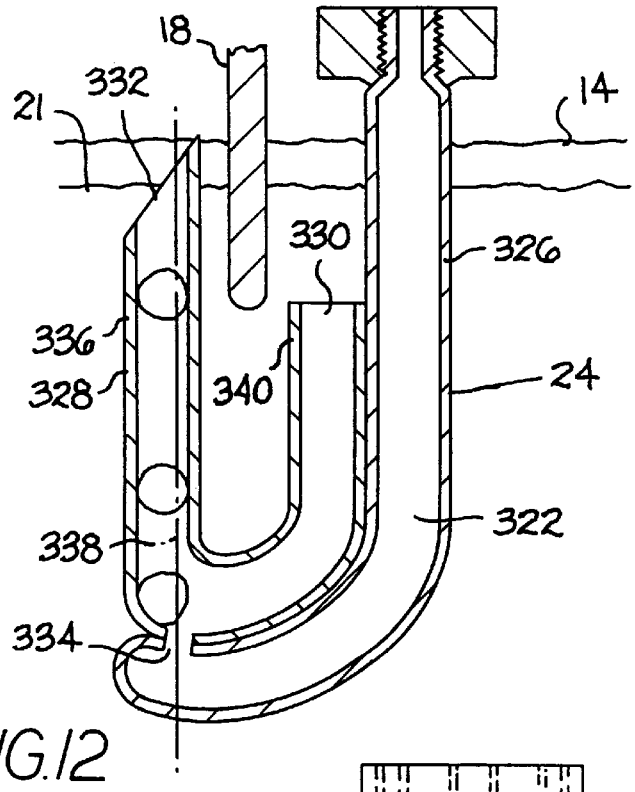
FIG. 12 is an enlarged sectional view (from the front of FIG. 1) of a dross diluting pump.

Referring now to FIG. 12, a dross diluting pump 24 is depicted. Generally, pump 24 can be constructed of the same materials described above with respect to the dross removing pump. The primary distinction is that the pump flow direction has been reversed by changing the pump gas inlet position, thus introducing fresh metal into the snout internal chamber. In this manner, molten metal is drawn into pump 24 through inlet 330 and released at pump outlet 332 into the dross layer 21, diluting the dross layer. While beneficial alone, the simultaneous interaction of a dross diluting pump 24 and a dross removing pump 22 (see FIG. 1) results in an excellent minimization of dross levels and improved metal treating.

Preferably, the elements of the pump are comprised of graphite, ceramic or molten metal resistant alloys according to the considerations discussed above. Furthermore, the gas delivery system will be the same as described above. Accordingly, gas travels down passage 322 in gas delivery leg 326 and exits through jet orifice 334 forming bubbles in outlet leg 336 of pump body 328—along axis 338—drawing metal into inlet leg 340. In this manner, "clean" metal is pulled from outside snout housing 18 and infused into the dross layer 21 inside the snout housing through pump outlet 332.

Figure 13:
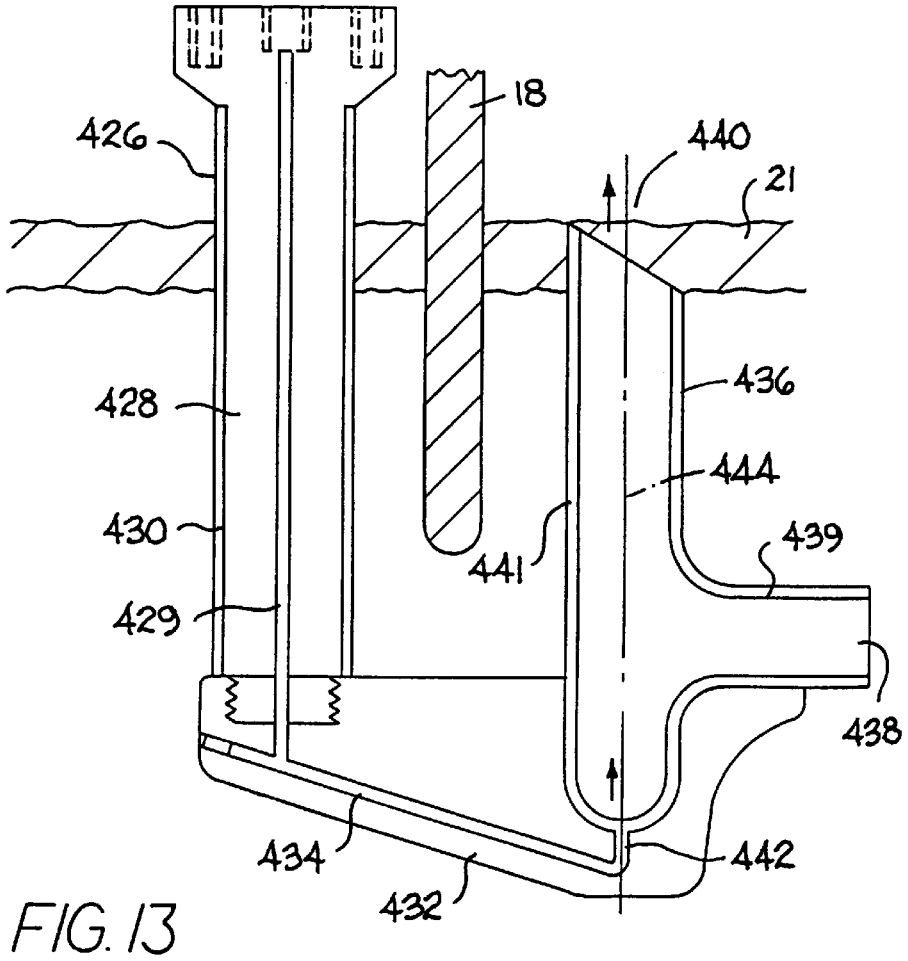
FIG. 13 is an enlarged sectional view (from the rear of FIG. 1) of an alternative dross diluting pump.

Turning to an alternative form of the dross diluting pump, reference is made to FIG. 13. In this embodiment, a similar construction is provided, however, the pump is a hybrid, comprised of a combination of graphite and ceramic elements. In this manner, the device is particularly suited for use in aluminum environments. Specifically, a gas delivery leg 426 is constructed of a first graphite body 428, including bore 429 and a protective ceramic sleeve 430. Leg 426 is threadedly connected to a graphite base element 432 including a gas delivery passage 434. Bore 429 and passage 434 are fluidly connected. Base element 432 is connected, preferably with cement, to pump body 436 which is preferably comprised of ceramic. Pump body 436 includes inlet opening 438 to inlet leg 439, and outlet opening 440 from outlet leg 441. Gas from the type of system described above is injected as a jet through orifice 442 along the vertical axis 444 of outlet leg 441. In this manner, "clean" metal is drawn upwardly to dilute dross layer 21 inside housing 18.

Figure 14:
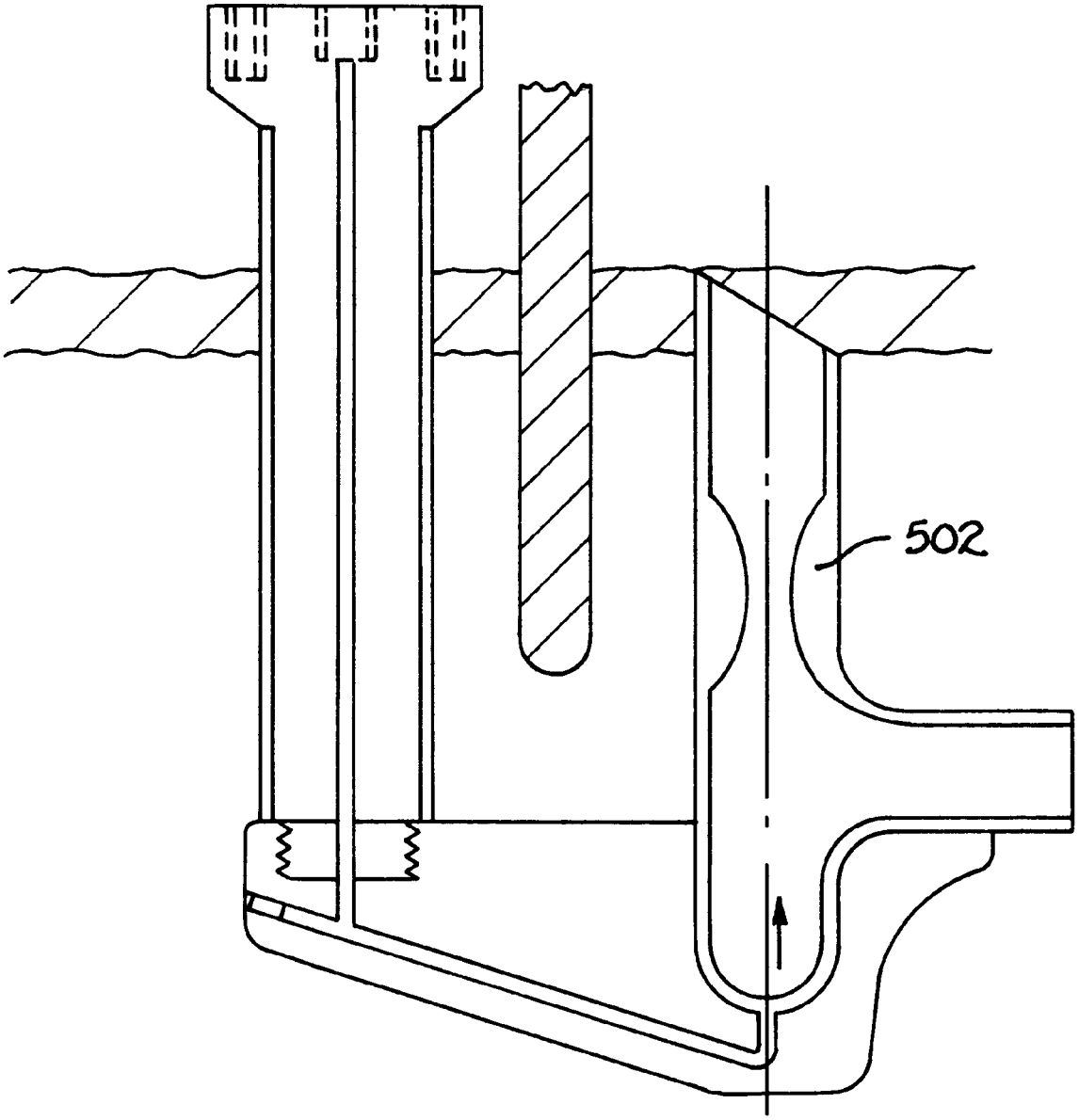
FIG. 14 is an enlarged sectional view (from the rear of FIG. 1) of a further alternative dross diluting pump.

Turning next to FIG. 14, an alternative embodiment of the dross diluting pump is depicted wherein a convergent/divergent nozzle 502 is utilized. In this regard, the design and function of nozzle 502 is equivalent to that described above in the dross removing embodiment (see FIGS. 10 and 11) and can be constructed in accord with the above-detailed shape. Furthermore, the convergent/divergent nozzle can be employed in any style of dross diluting pump; including the pump of FIG. 12.

Thus it is apparent that there has been provided, in accordance with the invention a pump that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having described my invention, I claim:

1. In a metal treating apparatus having a container for holding a bath of molten metal, a gas-filled housing for enclosing a moving strip of metal, the housing having an opening in said bath of molten metal below the level thereof, through which the strip of metal exits the housing while submerged in the molten metal, and an apparatus for removing a layer of dross from the surface of the metal bath inside the gas-filled housing, comprising:

a conduit having an inlet opening adjacent the surface of the molten metal for receiving dross into the conduit;

the conduit having an outlet opening for discharging dross received through said inlet opening;

the conduit having a gas-receiving opening below the outlet opening, such that a gas rises in said conduit to induce a flow of dross into said inlet opening and towards said outlet opening; and the gas-receiving opening being disposed to discharge the gas into the conduit in the same direction s the dross flows in the conduit.

2. The apparatus of claim 1, in which the gas-receiving opening is disposed adjacent the lowest portion of the conduit, and vertically beneath the outlet opening.

3. The apparatus of claim 1, further comprising a second conduit for introducing the gas, attached to the first conduit, the first conduit comprising a generally U-shaped member having a pair of vertical legs with openings in their respective upper ends for respectively receiving and discharging the dross.

4. The apparatus of claim 1, wherein said conduit is comprised of a material selected from stainless steel, metal alloy, graphite, ceramic or mixtures thereof.

5. The apparatus of claim 1, including an apparatus for introducing the gas intermittently into the conduit to form a series of spaced rising bubbles which entrap and move sections of molten metal and dross.

6. The apparatus of claim 1, including a vertically oriented gas delivery leg secured to a base member, said gas delivery leg having a gas passage in fluid communication with a gas duct in said base member, said conduit being secured to said base member wherein said gas-receiving opening is in fluid communication with said gas duct.

7. The apparatus of claim 1, further including a convergent/divergent nozzle in the conduit.

8. The apparatus of claim 7, in which the convergent/divergent nozzle is disposed between the gas receiving opening and the outlet opening.

9. The apparatus of claim 6, wherein said gas delivery leg is comprises of a graphite body housed in a ceramic sleeve.

10. A metal treating process in which a moving strip of metal passes through a bath of molten metal in a gas-filled housing which encloses the moving strip of metal, the housing having an opening in said bath of molten metal below the level thereof, through which the strip of metal exits the housing while submerged in the molten metal, a method for moving a material selected from molten metal, dross or mixtures thereof inside the gas-filled housing, comprising:

positioning a conduit having an inlet opening adjacent either the surface of the molten metal for receiving dross into the conduit, or below the surface for receiving molten metal and an outlet opening for discharging the received dross or molten metal; and introducing a gas into the conduit in the same direction as the motion of the metal or dross, whereby the gas rises in the conduit to induce a flow of dross into the inlet opening and towards the outlet opening.

11. An apparatus for removing a layer of dross from the surface of a metal bath comprising a generally U-shaped conduit including a first leg having an inlet opening, and a second leg having an outlet opening for discharging dross receiving through said inlet opening, the second leg having a longitudinal axis wherein a gas-receiving opening and the outlet opening lie generally on said longitudinal axis.

12. The apparatus of claim 11, including a pump body mated with the conduit adjacent the gas-receiving opening, an elongated gas delivery member having a gas passage for delivering gas and a lower end threadably connected to a threaded section of the pump body and an upper end extending above the U-shaped conduit and adapted for receiving a gas, and a sleeve encasing the gas delivery member.

13. The apparatus of claim 12, in which the pump body is formed of graphite.

14. The apparatus of claim 12, in which the gas delivery member is formed of graphite, and the sleeve is formed of a ceramic.

15. The apparatus of claim 11, in which the conduit is formed of a ceramic.

16. The apparatus of claim 11, including a tubular member forming a gas delivery element.

17. In a metal treating apparatus having a container for holding a bath of molten metal, a gas-filled housing for enclosing a moving trip of metal, the housing having an opening in said bath of molten metal below the level thereof, through which the strip of metal enters the housing while submerged in the molten metal, and an apparatus for diluting a layer of dross at the surface of the metal bath inside the gas-filled housing, comprising:

a conduit having an inlet opening below the surface of the molten metal;

the conduit having an outlet opening adjacent the layer of dross;

the conduit having a gas-receiving opening below the outlet opening such that gas rises in said conduit to induce a flow of metal into said inlet opening and towards said outlet opening; and the gas-receiving opening being disposed to discharge the gas into the conduit in the same direction as metal flows in the conduit.

18. The apparatus of claim 16, further including a convergent/divergent nozzle in the conduit.

19. An apparatus for diluting a layer of dross at the surface of a metal bath comprising a generally U-shaped conduit having a first leg having an inlet opening, and a second leg having an outlet opening for discharging metal received through said inlet opening, the conduit having a gas-receiving opening below the outlet opening, a pump body mated with the conduit adjacent the gas-receiving opening, an elongated gas delivery member having a lower end threadably connected to a threaded section of the pump body and an upper end, extending above the second leg and adapted for receiving a gas, and a sleeve encasing the gas delivery member, the sleeve having an upper end above the second leg, said pump body and said gas delivery member including a gas passage for delivering gas into said conduit.

20. The apparatus of claim 19, in which the body is formed of graphite.

21. The apparatus of claim 20, in which the gas delivery member is formed of graphite and the sleeve is formed of a ceramic.

22. An apparatus for displacing molten metal in a metal bath comprising a generally U-shaped conduit comprised of ceramic, graphite, stainless steel, temperature resistant alloy, or mixtures thereof, said U-shaped conduit including a first leg having an inlet opening, and a second leg having an outlet opening, the second leg having a longitudinal axis wherein a gas receiving opening and the outlet opening lie generally on said longitudinal axis.

23. The apparatus of claim 22, including a pump body mated with the conduit adjacent the gas receiving opening, an elongated gas delivery member having a gas passage for delivering gas into said conduit and a lower end threadably connected to a threaded section of the pump body and an upper end, extending above the U-shaped conduit and adapted for receiving a gas, and a sleeve encasing the gas delivery member.

24. The apparatus of claim 22, including a tubular member forming a gas delivery element.

* * * * *